US011118323B1

(12) United States Patent
Putnam

(10) Patent No.: US 11,118,323 B1
(45) Date of Patent: Sep. 14, 2021

(54) TRAFFIC-COMPATIBLE VENTED PRECIPITATION GUARDING MANHOLE COVER ASSEMBLIES

(71) Applicant: David Putnam, Calhoun, LA (US)

(72) Inventor: David Putnam, Calhoun, LA (US)

( * ) Notice: Subject to any disclaimer, the term of this patent is extended or adjusted under 35 U.S.C. 154(b) by 0 days.

(21) Appl. No.: 15/613,392

(22) Filed: Jun. 5, 2017

(51) Int. Cl.

| | |
|---|---|
| ***E02D 29/14*** | (2006.01) |
| *E02D 29/00* | (2006.01) |
| *E02D 29/12* | (2006.01) |
| *E03F 5/02* | (2006.01) |

(52) U.S. Cl.
CPC ..... *E02D 29/14* (2013.01); *E02D 29/12* (2013.01); *E03F 5/02* (2013.01); *E05Y 2900/612* (2013.01)

(58) Field of Classification Search
CPC . E02D 29/12; E02D 29/14; E03F 5/02; E05Y 2900/612
USPC ..... 52/20, 218, 219, 302.7; 404/25
See application file for complete search history.

(56) References Cited

U.S. PATENT DOCUMENTS 2,009,132 A 7/1935 Gehris
2,625,731 A * 1/1953 Richmond ..... A61G 17/02 220/849
3,263,580 A * 8/1966 MacMillan ..... E02D 29/14 404/25
3,530,882 A 9/1970 Case et al.
3,798,848 A 3/1974 Campagna
3,799,686 A * 3/1974 Williams ..... E01F 9/629 404/10
3,920,347 A * 11/1975 Sauriol ..... E02D 29/124 210/166
3,975,870 A * 8/1976 Naka ..... E02D 29/14 404/25
4,067,659 A 1/1978 Campagna, Jr. et al.
4,084,914 A * 4/1978 Humphrey ..... E01F 9/629 256/1
4,137,662 A * 2/1979 Baumer ..... E01F 9/627 40/608
4,195,945 A * 4/1980 Heenan ..... E01C 23/0946 404/16
4,373,464 A * 2/1983 Blau ..... F16F 3/10 116/63 R
4,442,647 A * 4/1984 Olsen ..... B64C 1/40 244/119
4,462,711 A * 7/1984 Garner ..... E01F 9/692 116/63 R
4,512,492 A 4/1985 Graybeal
4,542,709 A * 9/1985 Spaugh ..... B60Q 7/00 116/63 P
4,552,089 A * 11/1985 Mahoney ..... G08B 5/00 116/63 P
4,564,309 A * 1/1986 Bjorlund ..... E01F 9/627 404/10
4,586,941 A 5/1986 Cooley
(Continued)

*Primary Examiner* — Brian D Mattei
*Assistant Examiner* — Joseph J. Sadlon
(74) *Attorney, Agent, or Firm* — R. Keith Harrison

(57) ABSTRACT

Traffic-compatible vented precipitation guarding manhole cover assemblies may include a manhole cover having an exterior manhole cover surface and an interior manhole cover surface. At least one opening may extend through the manhole cover from the interior manhole cover surface to the exterior manhole cover surface. A flexible, resilient extension conduit having elastic recoil memory may extend from the exterior manhole cover surface at the at least one opening.

14 Claims, 11 Drawing Sheets

(56) References Cited

U.S. PATENT DOCUMENTS 4,768,675 A 9/1988 Coleman
4,801,483 A * 1/1989 Beckerman ..... B29C 70/865 428/71
4,807,675 A * 2/1989 Sharp ..... B65D 90/105 137/547
4,932,185 A * 6/1990 Lebel ..... A47L 3/04 52/37
4,969,770 A * 11/1990 Bowman ..... E02D 29/124 404/26
5,052,851 A * 10/1991 Frishauf ..... E02D 29/124 404/25
5,186,119 A * 2/1993 Hlavin ..... A63C 19/062 116/201
5,253,952 A * 10/1993 Selway ..... A01G 25/00 404/25
5,303,668 A * 4/1994 Huang ..... B60Q 7/00 116/63 P
5,401,114 A * 3/1995 Guggemos ..... E02D 29/14 137/364
5,462,004 A * 10/1995 McGIothin ..... B60Q 7/00 116/173
5,524,858 A * 6/1996 Friend ..... A47G 29/1216 232/39
5,582,720 A * 12/1996 Deming ..... E02D 29/14 210/164
5,727,351 A * 3/1998 Neathery ..... E02D 29/12 292/237
5,832,673 A * 11/1998 Cho ..... E02D 29/14 220/319
5,846,274 A 12/1998 Smelser
5,924,846 A 7/1999 Arnold, Jr. et al.
6,149,340 A * 11/2000 Pateman ..... E01F 9/627 40/608
6,682,257 B1 * 1/2004 Zappe ..... E02D 29/14 404/25
6,688,807 B2 * 2/2004 Navarrete ..... E02D 29/14 404/25
6,848,465 B1 2/2005 Ledbetter
6,887,012 B1 * 5/2005 Zappe ..... E02D 29/14 404/25
6,986,227 B1 * 1/2006 Gavin ..... E02D 29/12 220/4.27
7,389,616 B2 * 6/2008 Gilleran ..... E04F 13/0869 52/219
7,798,742 B2 * 9/2010 Nolle ..... E05B 35/008 404/25
7,861,485 B1 * 1/2011 Wentworth ..... E04D 1/30 182/45
8,202,020 B2 * 6/2012 Hughes, Jr. ..... E01F 9/588 404/9
8,534,484 B2 * 9/2013 Rost ..... H02G 9/10 220/237
8,814,254 B1 * 8/2014 Peffley ..... B62D 25/209 296/183.1
8,851,791 B1 * 10/2014 Putnam ..... E03F 5/08 404/25
9,249,553 B2 * 2/2016 Perron ..... B01D 46/0028
9,551,141 B2 * 1/2017 Clinton ..... E03F 5/041
9,605,403 B1 3/2017 Putnam
9,890,513 B1 * 2/2018 Wu ..... E02D 29/14
10,132,052 B2 * 11/2018 Dang ..... E04H 9/12
10,214,345 B1 * 2/2019 Howie ..... B65D 90/105
10,550,540 B2 * 2/2020 De Siena ..... E05C 9/10
10,640,965 B2 * 5/2020 Son ..... E03F 5/04
2012/0227168 A1 9/2012 Paoluccio et al.
2013/0174776 A1 * 7/2013 Hughes, Jr. ..... E01F 9/0122 116/63 P
2016/0138229 A1 * 5/2016 Hughes, Jr. ..... E01F 9/60 404/13
2019/0100907 A1 * 4/2019 Son ..... C02F 1/40

* cited by examiner

72

TRAFFIC-COMPATIBLE VENTED PRECIPITATION GUARDING MANHOLE COVER ASSEMBLIES

FIELD

Illustrative embodiments of the disclosure generally relate to manhole covers for manhole openings which overlie sewer systems. More particularly, illustrative embodiments of the disclosure relate to traffic-compatible vented precipitation guarding manhole cover assemblies which close a manhole opening in a manhole structure above a sanitary sewer and vent sewer gas from the sewer as well as prevent or limit flow of precipitation into and overflow of storm water from the sewer, and are compatible with automotive, vehicular, pedestrian and other traffic traversing the manhole cover.

BACKGROUND

The background description provided herein is solely for the purpose of generally presenting the context of the illustrative embodiments of the disclosure. Aspects of the background description are neither expressly nor impliedly admitted as prior art against the claimed subject matter.

Sanitary sewers are subterranean tunnels which transport raw sewage from houses and commercial buildings to a treatment or disposal facility. Sewers may include pipelines which connect houses and buildings to one or more levels of larger underground trunk mains. Manholes are periodically-shaped vertical openings which connect the trunk mains to the ground surface for sewer gas venting and other purposes. Manhole covers are plates which are seated in manhole openings at the ground surface to close the manholes. The manhole covers can be selectively unseated from the manhole openings to provide access to the underlying subterranean sewer structure for cleaning, maintenance or repair.

Traffic-compatible vented precipitation guarding manhole cover assemblies which close a manhole opening in a manhole structure above a sanitary sewer and vent sewer gas from the sewer as well as prevent or limit flow of precipitation into and overflow of storm water from the sewer, and are compatible with automotive, vehicular, pedestrian and other traffic traversing the manhole cover may be desirable for some applications.

SUMMARY

Illustrative embodiments of the disclosure are generally directed to traffic-compatible vented precipitation guarding manhole cover assemblies which close a manhole opening in a manhole structure above a sanitary sewer and vent sewer gas from the sewer as well as prevent or limit flow of precipitation into and overflow of storm water from the sewer. The assemblies are compatible with automotive, vehicular, pedestrian and other traffic traversing the manhole cover. An illustrative embodiment of the traffic-compatible vented precipitation guarding manhole cover assemblies may include a manhole cover having an exterior manhole cover surface and an interior manhole cover surface. At least one opening may extend through the manhole cover from the interior manhole cover surface to the exterior manhole cover surface. A flexible, resilient extension conduit having elastic recoil memory may extend from the exterior manhole cover surface at the at least one opening.

BRIEF DESCRIPTION OF THE DRAWINGS

Illustrative embodiments of the disclosure will now be described, by way of example, with reference to the accompanying drawings, in which.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper". "lower" "left", "rear", "right", "front", "vertical". "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 10:
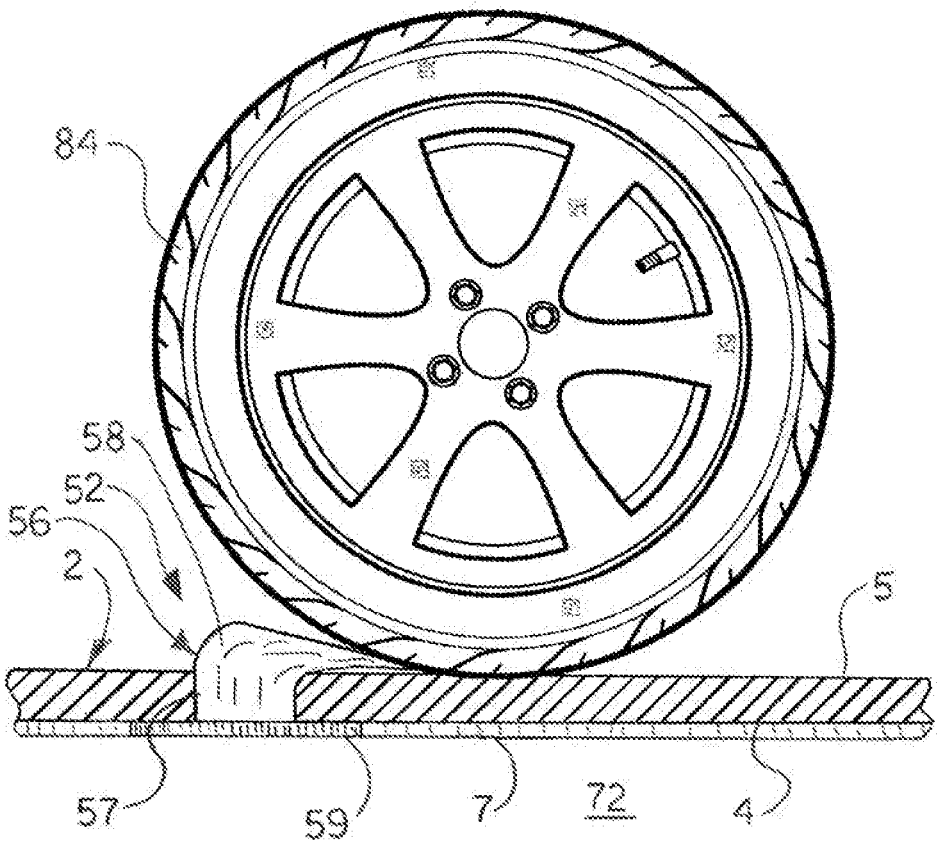
FIG. 10 is an enlarged sectional view of a portion of the illustrative traffic-compatible vented precipitation guarding manhole cover assembly illustrated in FIG. 9, with the automobile wheel rolling over the extension conduit and the extension conduit compressed between the automobile wheel and the manhole cover as the automobile wheel traverses the extension conduit.
Figure 11:
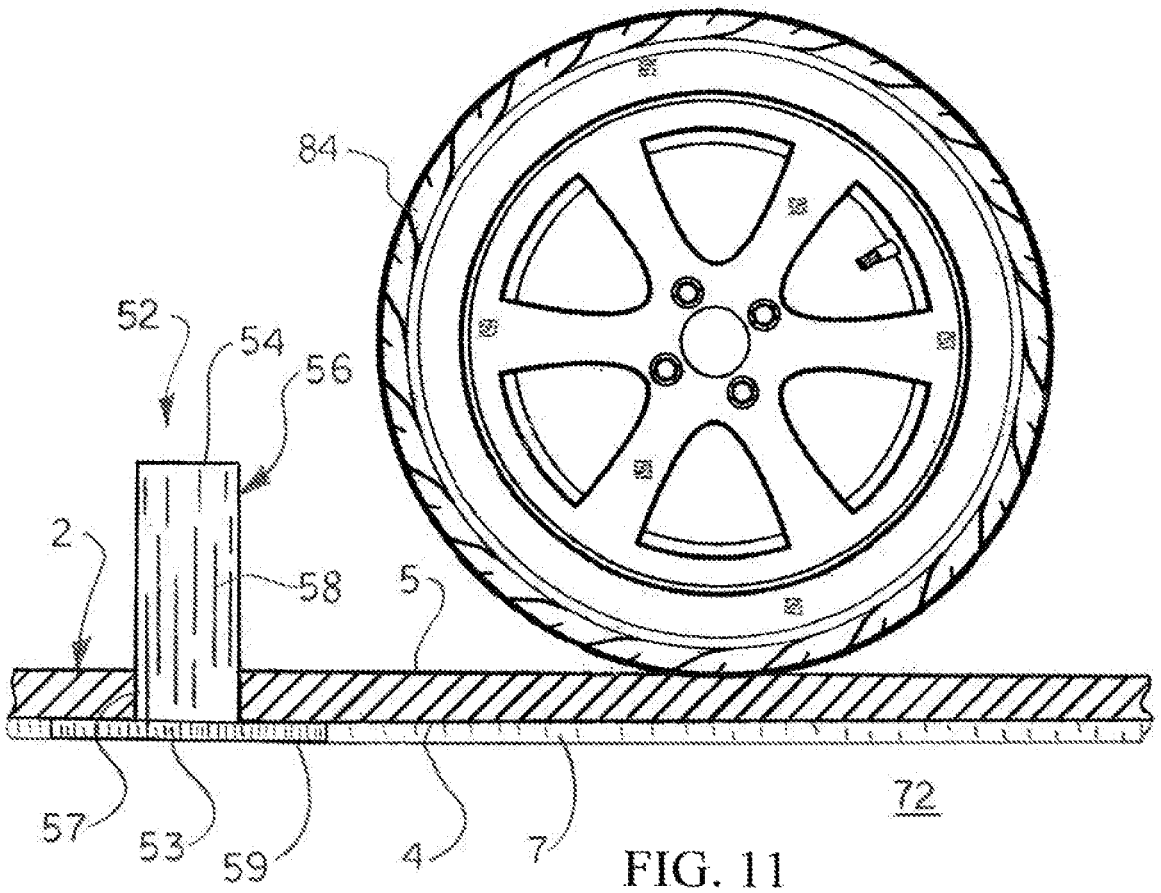
FIG. 11 is an enlarged sectional view of a portion of the illustrative traffic-compatible vented precipitation guarding manhole cover assembly illustrated in FIG. 9, after the automobile wheel has rolled over the extension conduit, with the extension conduit recoiled back to the upward-standing, erect, functional position.

Referring to the drawings, an illustrative embodiment of the traffic-compatible vented precipitation guarding manhole cover assemblies, hereinafter assembly, is generally indicated by reference numeral 1. As illustrated in FIGS. 8-11 and will be hereinafter further described, in typical application, the assembly 1 may be mounted in a manhole structure 70. The manhole structure 70 may have a manhole shoulder 71 and a manhole opening 72 circumscribed by the manhole shoulder 71. In some applications, the manhole structure 70 may extend into the ground or a roadway surface 86. The manhole opening 72 may communicate with an underlying sanitary sewer 74 beneath the ground or roadway surface 86. As further illustrated in FIG. 8, the assembly 1 may vent or discharge sewer gas 60 such as hydrogen sulfide and mercaptan, for example and without limitation, from the sewer 74 through the manhole opening 72 to the atmosphere 66, as well as prevent or substantially limit the quantity of falling precipitation 78 from the atmosphere 66 and/or pooled precipitation 76 from the ground or roadway surface 86 which may enter the sewer 74 through the manhole opening 72. The assembly 1 may further prevent storm water 80 from rising from the sewer 74, overflowing the manhole opening 72 and flooding or contaminating the ground or roadway surface 86. As illustrated in FIGS. 9-11, the assembly 1 may be compatible with automotive traffic as an automobile wheel 84 on an automobile which travels on the roadway surface 86 traverses the assembly 1, as will be hereinafter described, as well as other vehicular traffic and pedestrian traffic, for example and without limitation.

Figure 1:
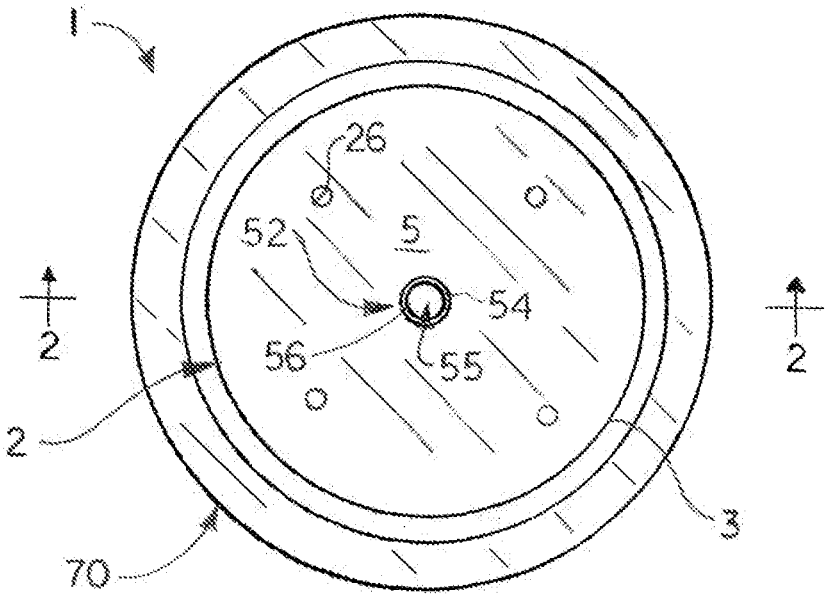
FIG. 1 is a top view of an illustrative embodiment of the traffic-compatible vented precipitation guarding manhole cover assemblies.
Figure 2:
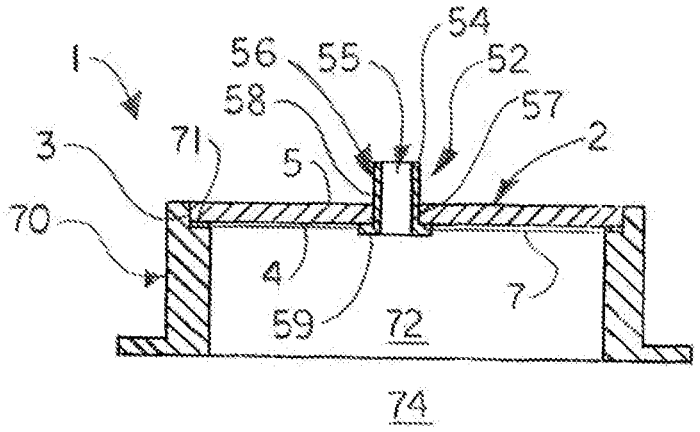
FIG. 2 is a cross-sectional view, taken along section lines 2-2 in FIG. 1, of the illustrative traffic-compatible vented precipitation guarding manhole cover assembly.
Figure 3:
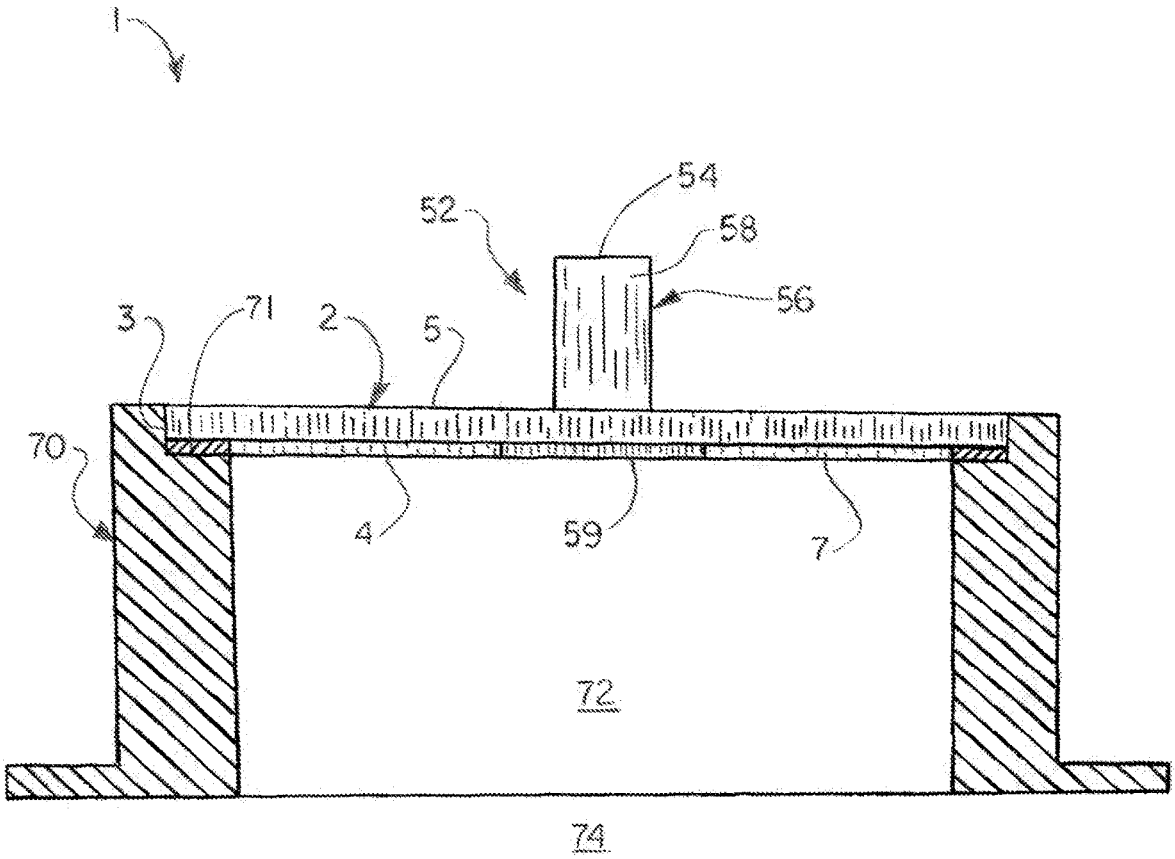
FIG. 3 is a side view of an illustrative traffic-compatible vented precipitation guarding manhole cover assembly deployed in place in a manhole structure (shown in cross-section) in typical application of the assembly.
Figure 4:
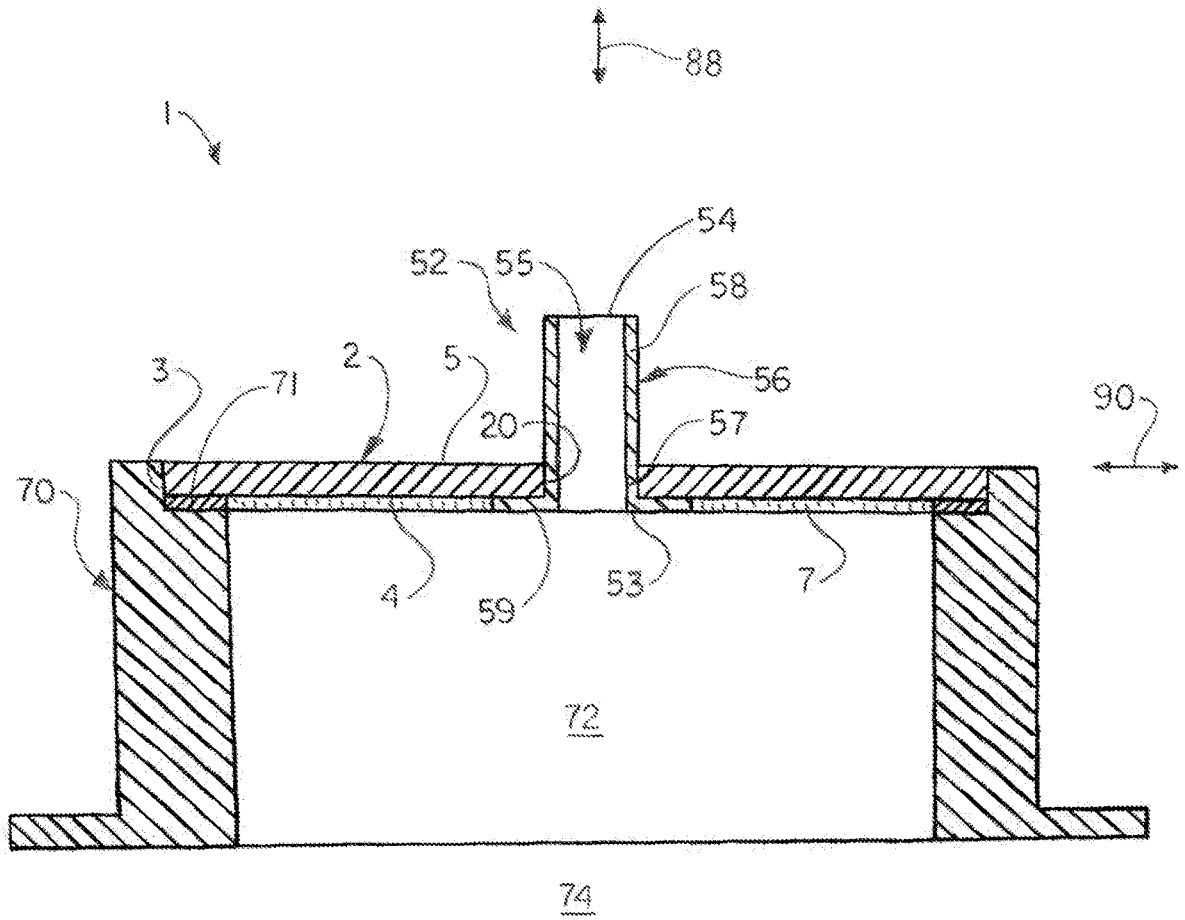
FIG. 4 is a cross-sectional view of the illustrative traffic-compatible vented precipitation guarding manhole cover assembly illustrated in FIG. 3, deployed in place on the manhole structure (shown in cross-section)
Figure 5:
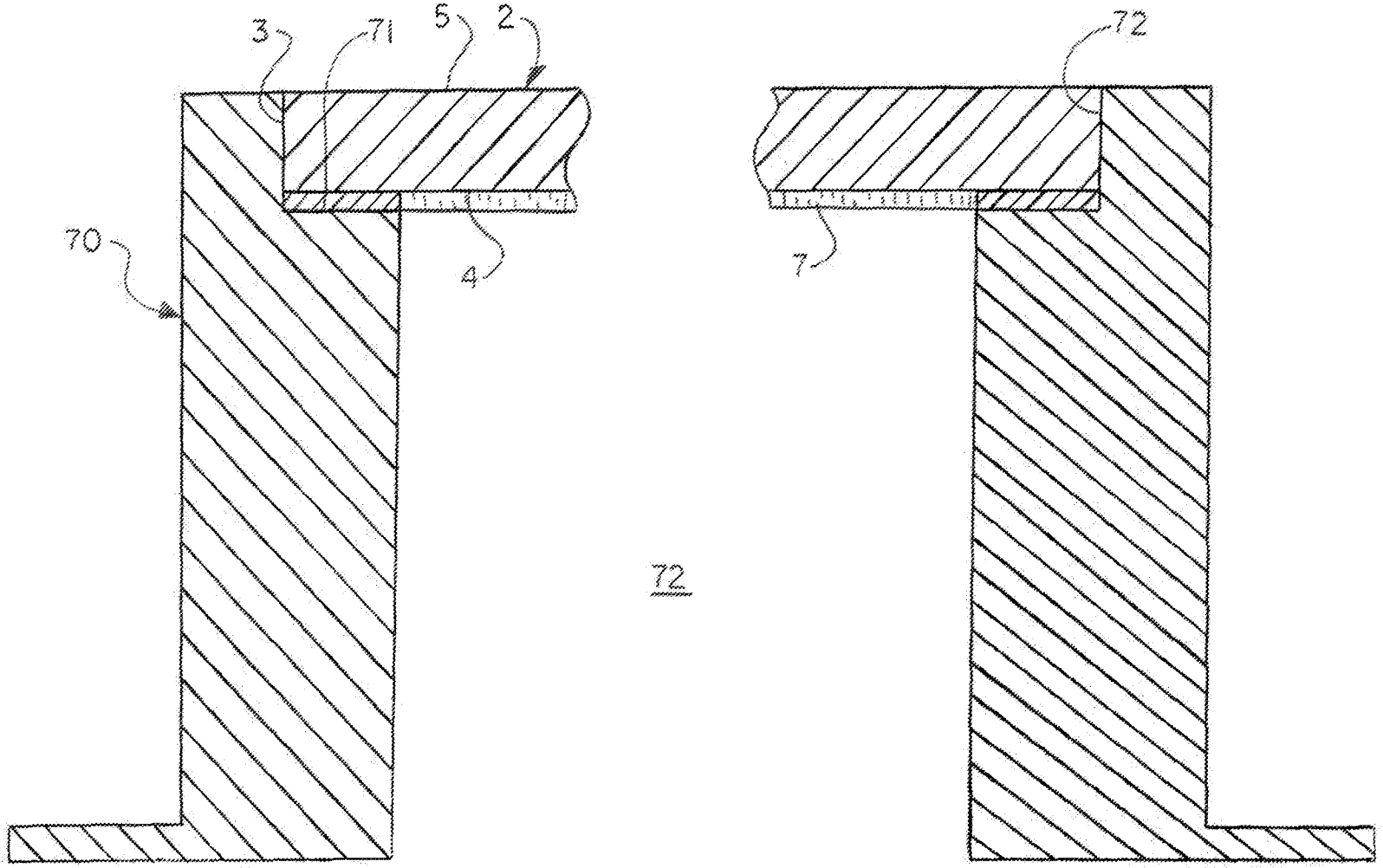
FIG. 5 is an enlarged sectional view of an illustrative traffic-compatible vented precipitation guarding manhole cover assembly, with the manhole cover of the assembly seated on a manhole shoulder in the manhole structure and a typical manhole cover seal sandwiched between the manhole shoulder and the manhole cover.

As illustrated in FIGS. 1-8, the assembly 1 may include a manhole cover 2. The manhole cover 2 may include steel, aluminum, carbon fiber composite, inert plastic or other suitable material, or any combination thereof. The manhole cover 2 may have an interior manhole cover surface 4 which faces the manhole opening 72, a generally planar exterior manhole cover surface 5 which faces the atmosphere 66 and an annular manhole cover edge 3 which circumscribes the interior manhole cover surface 4 and the exterior manhole cover surface 5 and faces the manhole structure 70 when the manhole cover 2 is seated on the manhole shoulder 71. As illustrated in FIG. 5, at least one manhole cover seal 7 may be provided on and/or protrude from at least one of the interior manhole cover surface 4 of the manhole cover 2 and the manhole shoulder 71 of the manhole structure 70. In some embodiments, at least one annular cover seal groove (not illustrated) may be provided in the interior manhole cover surface 4. At least one annular manhole cover seal 7 may be provided in the cover seal groove for sealing purposes. Additionally or alternatively, at least one manhole cover seal 7 may be provided on and/or protrude from the manhole cover edge 3 of the manhole cover 2 for engagement with the vertical interior surface of the manhole structure 70. Still further in the alternative, at least one manhole cover seal 7 may be provided on the manhole shoulder 71 and/or other portion of the manhole structure 70. The manhole cover seal 7 may include any type of gasket, ring and/or other sealing element which is capable of imparting a fluid-tight seal between the manhole cover 2 and the underlying manhole shoulder 71 and/or other portion of the manhole structure 70 when the manhole cover 2 seats on the manhole shoulder 71. As illustrated in FIG. 1, at least one lift opening 26 may extend through the manhole cover 2 from the interior manhole cover surface 4 to the exterior manhole cover surface 5 to facilitate lifting of the manhole cover 2 from the manhole shoulder 71 and provide access to the underlying manhole opening 72 and sewer 74. In some embodiments, multiple lift openings 26 may extend through the manhole cover 2 at multiple, substantially geometrically off-centered positions.

Figure 6:
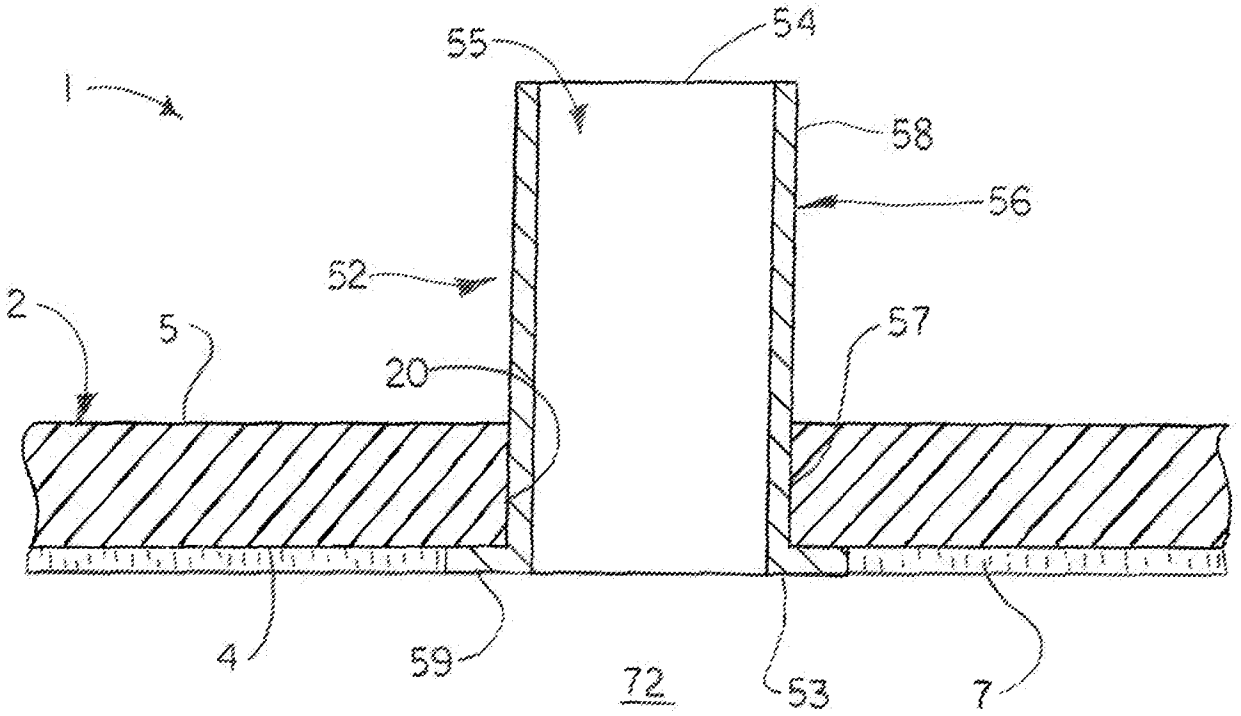
FIG. 6 is an enlarged sectional view of an illustrative traffic-compatible vented precipitation guarding manhole cover assembly, with a typical extension conduit extending through a manhole cover vent opening in the manhole cover.

At least one flexible or resilient extension conduit 52 may protrude from the exterior manhole cover surface 5 of the manhole cover 2. In some embodiments, the extension conduit 52 may be substantially centered on the exterior manhole cover surface 5. As illustrated in FIGS. 4 and 6, the extension conduit 52 may include a flexible or resilient conduit wall 56. The conduit wall 56 may have a conduit inlet end 53 and a conduit outlet end 54. The conduit wall 56 may define a conduit bore 55 which extends from the conduit inlet end 53 to the conduit outlet end 54. When the assembly 1 is deployed in place on the manhole structure 70, as illustrated in FIG. 4, the conduit bore 55 of the extension conduit 52 may communicate with the underlying manhole opening 72 of the manhole structure 70 through the manhole cover 2. As further illustrated in FIG. 4, in an erect, functional position of the extension conduit 52, the conduit wall 56 may define a longitudinal axis 88 which may be substantially perpendicular to a plane 90 of the exterior manhole surface 5 of the manhole cover 2. The conduit wall 56 of the extension conduit 52 may be fabricated of rubber, plastic, silicone, and/or other flexible or resilient, substantially durable and weather-resistant material having elastic recoil memory which is known by those skilled in the art.

The manhole cover 2 and the extension conduit 52 may be fabricated of casting, molding, machining and/or other suitable fabrication methods and techniques which are known by those skilled in the art. The manhole cover 2 and the extension conduit 52 may be fabricated in one piece, or alternatively, may be fabricated separately and mechanically joined according to the knowledge of those skilled in the art. As illustrated in FIGS. 4 and 6, in some embodiments, at least one manhole cover vent opening 20 may extend through the manhole cover 2 from the interior manhole cover surface 4 to the exterior manhole cover surface 5. In some embodiments, the vent opening 20 may extend through the manhole cover 2 at substantially a geometric center of the manhole cover 2. The extension conduit 52 may extend from the manhole cover vent opening 20. Thus, the conduit wall 56 of the extension conduit 52 may be suitably sized and configured to insert into or through the manhole cover vent opening 20. Accordingly, the conduit wall 56 may include a base wall portion 57 which may extend into or through the manhole cover vent opening 20 and an extending wall portion 58 which may extend from the base wall portion 57 beyond the exterior manhole cover surface 5 of the manhole cover 2. In some embodiments, a conduit flange 59 may protrude outwardly from the conduit wall 56 at or adjacent to the conduit inlet end 53 of the conduit wall 56. The conduit flange 59 may engage the interior manhole cover surface 4 of the manhole cover 2 to retain the extension conduit 52 in the manhole cover vent opening 20 for purposes which will be hereinafter described. In some embodiments, the conduit flange 59 may be fabricated in one piece with the conduit wall 56 of the extension conduit 52 using molding and/or other techniques known by those skilled in the art. In some embodiments, the conduit flange 59 and the conduit wall 56 may be fabricated separately and mechanically joined according to the knowledge of those skilled in the art.

Figure 7:
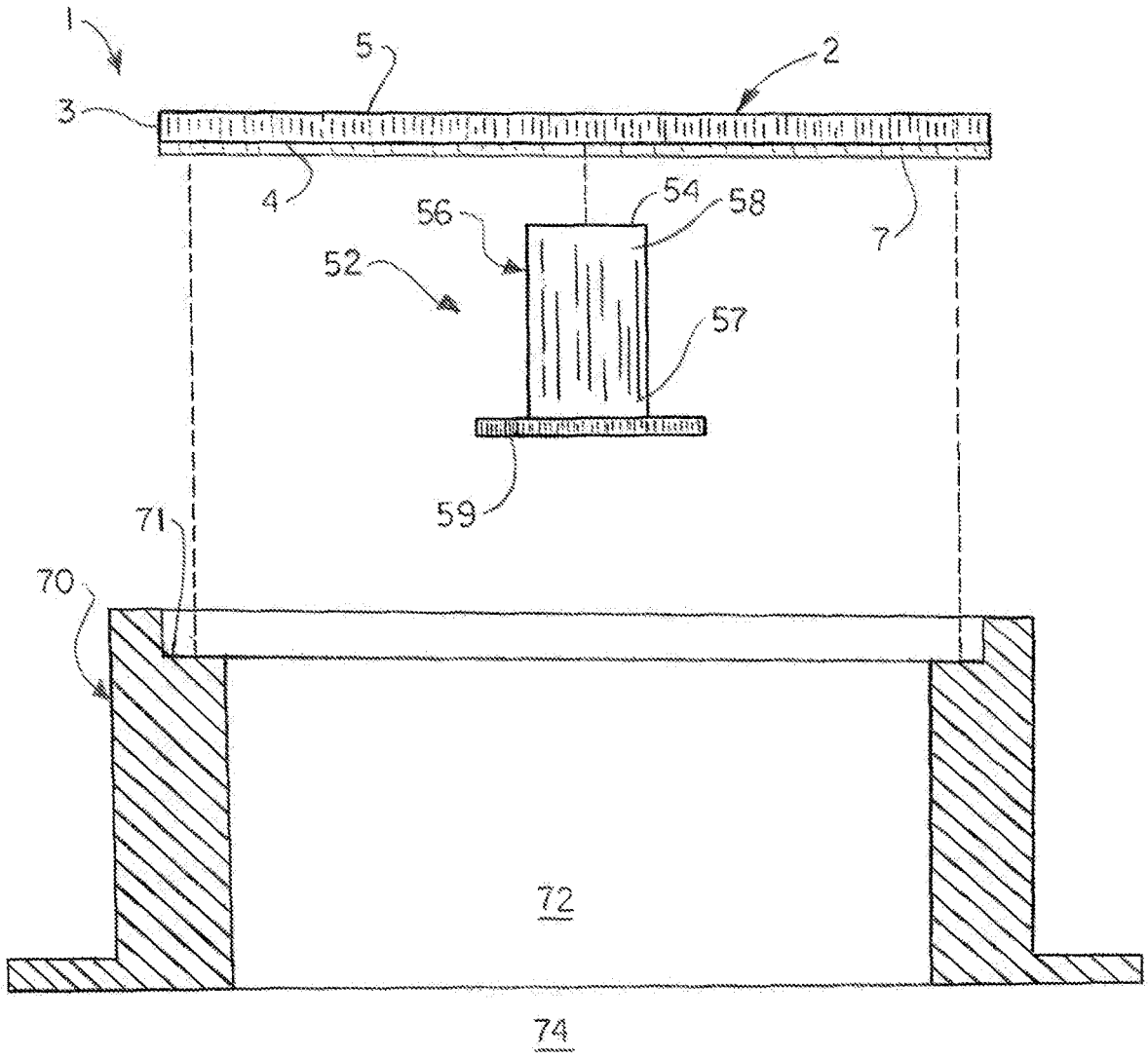
FIG. 7 is an exploded side view of an illustrative traffic-compatible vented precipitation guarding manhole cover assembly, with the manhole structure illustrated in section, more particularly illustrating typical deployment of the extension conduit in place in the manhole cover.

In some embodiments, the base wall portion 57 of the conduit wall 56 may be suitably sized and configured to achieve a friction-fit or interference fit in the manhole cover vent opening 20 of the manhole cover 2. Thus, as illustrated in FIG. 7, the extension conduit 52 may be installed by aligning the conduit wall 56 with the manhole cover vent opening 20 (FIG. 6) and inserting the conduit wall 56 upwardly from beneath the manhole cover 2 through the manhole cover vent opening 20 until the conduit flange 59 engages the interior manhole cover surface 4 of the manhole cover 2. In some embodiments, the conduit wall 56 may be attached to the interior surface of the manhole cover vent opening 20, and/or the conduit flange 59 may be attached to the interior manhole cover surface 4 of the manhole cover 2, using adhesives, mechanical fasteners and/or other fastening techniques known by those skilled in the art. In other embodiments, the manhole cover 2 and the extension conduit 52 may be fabricated in one piece or separately and mechanically joined according to other techniques known by those skilled in the art. For example and without limitation, in some embodiments, the conduit wall 56 of the extension conduit 52 may be seated on a shoulder (not illustrated) in the manhole cover vent opening 20, typically in the manner which is described in U.S. Pat. No. 9,605,403, which is incorporated by reference herein in its entirety. Accordingly, as illustrated in FIG. 8, when it is deployed in the manhole structure 70 in typical application of the assembly 1, the extension conduit 52 may facilitate venting of sewer gas 60 from the sewer 74 through the manhole opening 72 and the conduit bore 55 of the extension conduit 52, respectively, to the atmosphere 66 while preventing or minimizing entry of pooled precipitation 76 which may accumulate on the exterior manhole cover surface 5 of the manhole cover 2 into the sewer 74 through the conduit bore 55.

Figure 12:
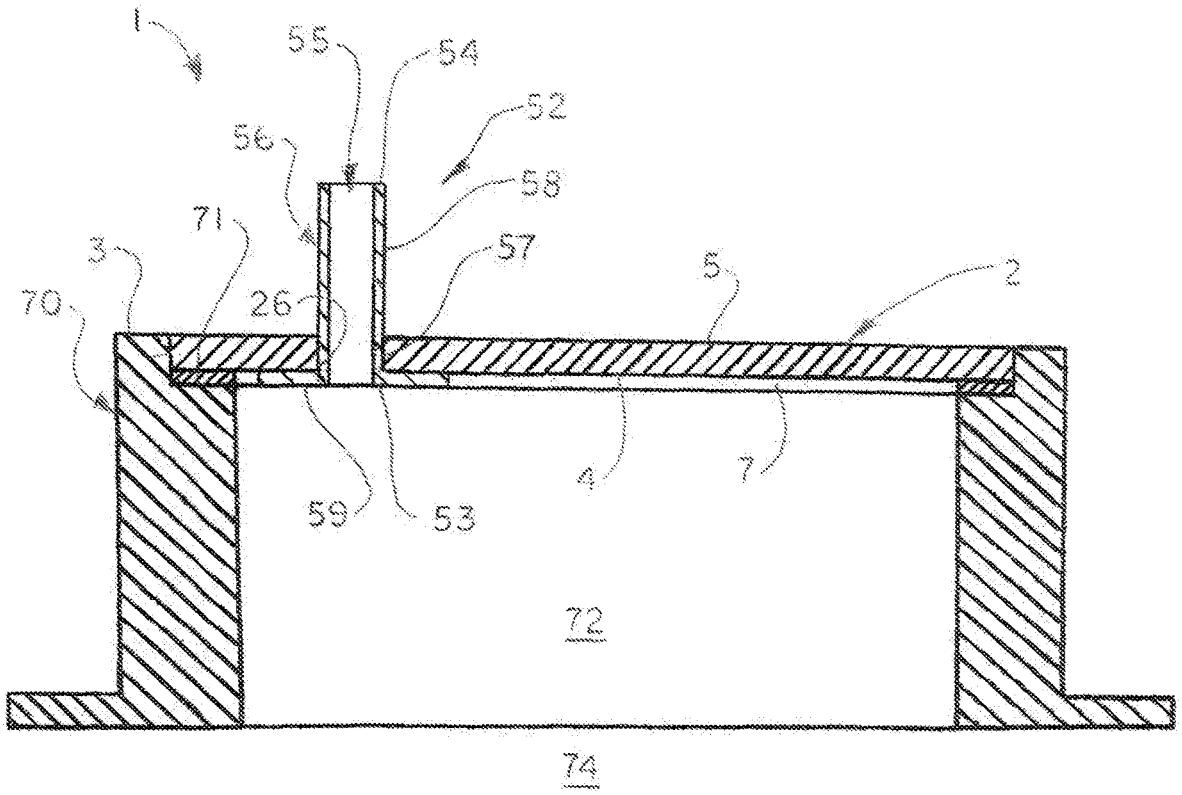
FIG. 12 is a cross-sectional view of an illustrative embodiment of the traffic-compatible vented precipitation guarding manhole cover assemblies, in which an extension conduit is deployed in a lift opening in the manhole cover (shown in cross-section).

As illustrated in FIG. 12, in some embodiments, an extension conduit 52 may additionally or alternatively extend from one of the lift openings 26 in the manhole cover 2. The extension conduit 52 may have the same design as or a similar design to that which is deployed in the manhole cover vent opening 20, as was heretofore described. The conduit wall 56 of the extension conduit 52 may be suitably sized and configured to insert into or through the lift opening 20. The conduit flange 59 may engage the interior manhole cover surface 4 of the manhole cover 2. Alternatively, the extension conduit 52 may be seated on a shoulder (not illustrated) in the lift opening 26 and/or secured in the lift opening 26 using alternative techniques, as was heretofore described.

As illustrated in FIGS. 8-11 of the drawings, in typical application, the assembly 1 may be installed over a manhole opening 72 in a manhole structure 70 which may extend into the ground or a roadway surface 86 and communicate with the subterranean sanitary sewer 74. In some applications, the manhole opening 72 may be circumscribed by a manhole shoulder 71 on the manhole structure 70. The manhole structure 70 may include steel, iron or other metal. The assembly 1 may be placed over the manhole opening 72 with the manhole cover seal 7 typically sandwiched between the manhole shoulder 71 and the manhole cover 2. In some applications, the manhole cover 2 may be bolted and/or otherwise fixedly secured over the manhole opening 72 according to the knowledge of those skilled in the art. The exterior manhole cover surface 5 of the manhole cover 2 may be generally flush with the ground or roadway surface 86.

Figure 8:
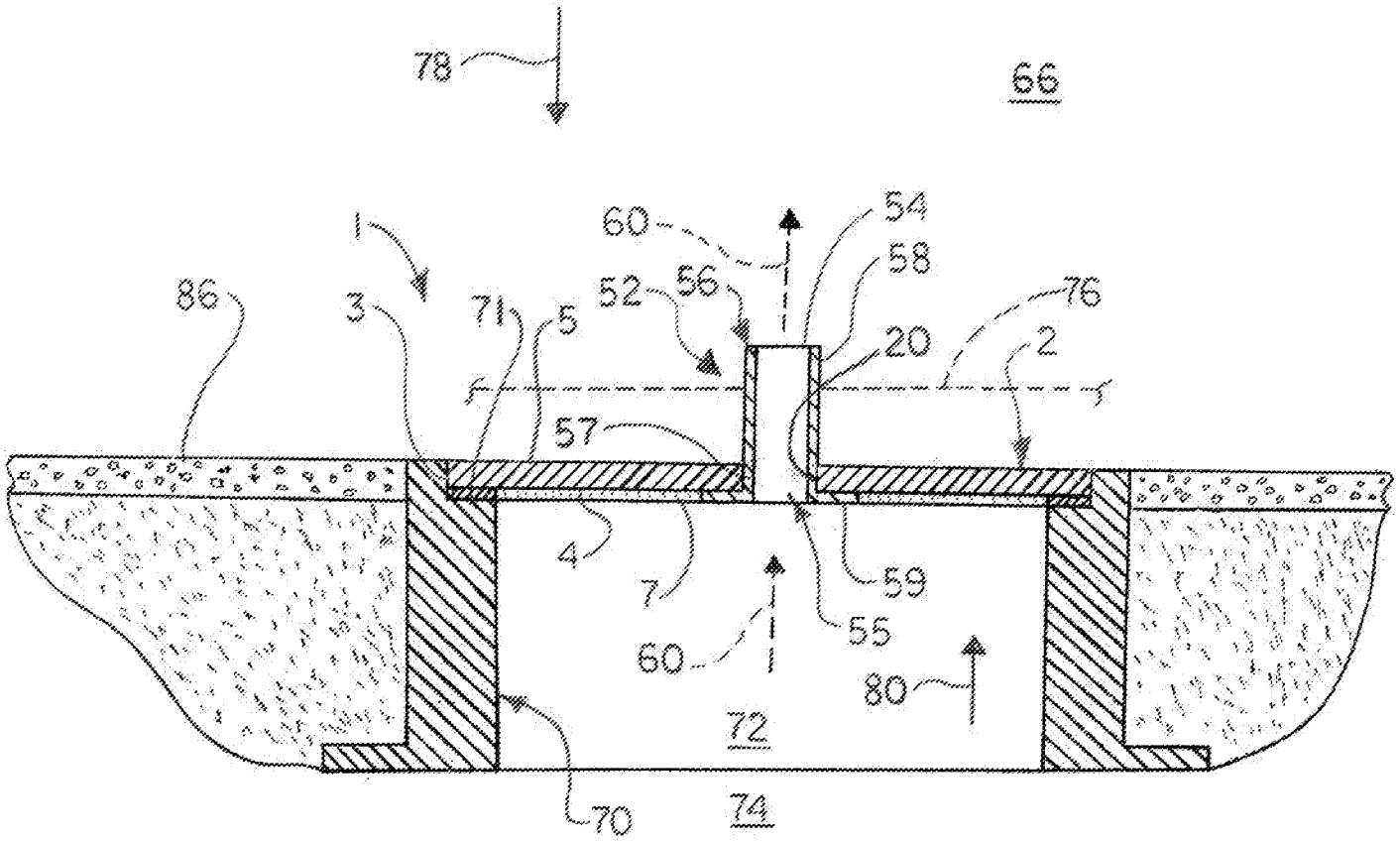
FIG. 8 is a sectional view of an illustrative traffic-compatible vented precipitation guarding manhole cover assembly, with the manhole structure (illustrated in section) deployed in a roadway surface and the assembly (also in section) seated on the manhole shoulder of the manhole structure in typical application of the assembly.
Figure 9:
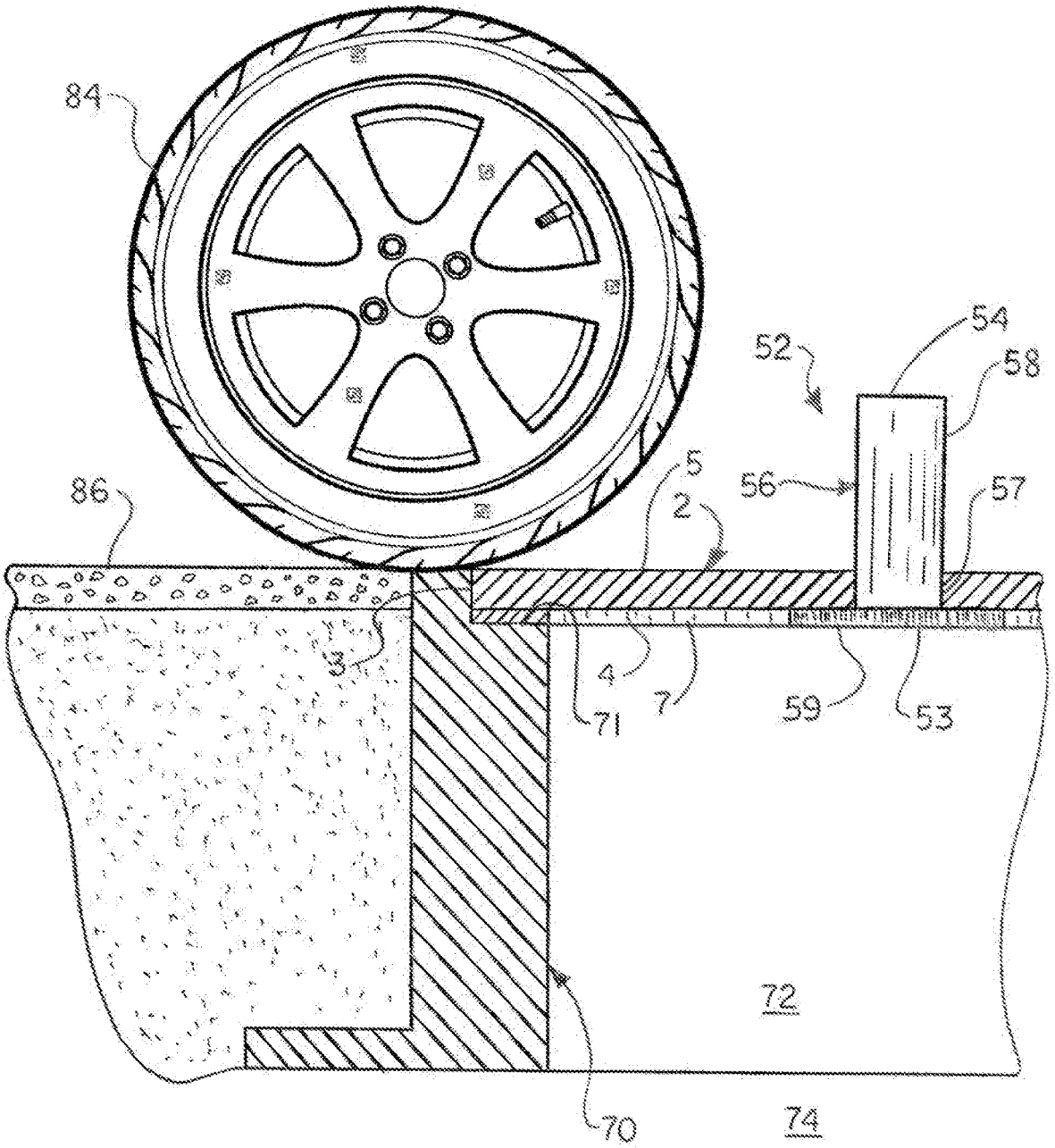
FIG. 9 is an enlarged sectional view of a portion of the manhole structure and the illustrative traffic-compatible vented precipitation guarding manhole cover assembly of FIG. 8 seated on the manhole shoulder in the manhole structure, further illustrating the extension conduit in the upward-standing, erect, functional position as an automobile wheel on an automobile approaches the extension conduit from the roadway surface.

As illustrated in FIGS. 8 and 9, the conduit wall 56 of the extension conduit 52 may normally extend in an upward-standing, erect, functional configuration beyond the exterior manhole cover surface 5 of the manhole cover 2. Accordingly, as illustrated in FIG. 8, sewer gas 60 may rise from the sewer 74 through the manhole opening 72 and flow through the conduit bore 55 from the conduit inlet end 53 to the conduit outlet end 54 of the extension conduit 52, and then discharge to the atmosphere 66. As further illustrated in FIG. 8, some of the falling precipitation 78, the quantity of which may be substantially limited by the diameter or width of the conduit bore 55 of the extension conduit 52, may be capable of entering the manhole opening 72 and the underlying sewer 74 through the conduit bore 55. In the event that the falling precipitation 78 forms pooled precipitation 76 which accumulates or pools on the ground or roadway surface 86 and on the exterior manhole cover surface 5 of the manhole cover 2, the height of the conduit wall 56 of the extension conduit 52 beyond the plane of the exterior manhole cover surface 5 of the manhole cover 2 and the ground or roadway surface 86 may additionally limit the quantity of the pooled precipitation 76 which can enter the sewer 74 by preventing the pooled precipitation 76 from flowing through the conduit bore 55 into the manhole opening 72 until the depth of the pooled precipitation 76 exceeds the height of the conduit outlet end 54 on the conduit wall 56.

As illustrated in FIG. 9, as an automobile (not illustrated) traverses the roadway surface 86, one or more automobile wheels 84 of the automobile may approach the erect conduit wall 56 of the extension conduit 52. As illustrated in FIG. 10, the automobile wheel 84 may next roll over the extension conduit 52. Under the weight of the automobile wheel 84, the extension conduit 52 may assume a compressed position in which it may be bended horizontally to the side in the direction of travel of the automobile wheel 84, or pressed downwardly along a vertical axis, and then substantially flattened or compressed between the automobile wheel 84 and the exterior manhole cover surface 5 of the manhole cover 2 as the automobile wheel 84 continues to traverse the roadway surface 86. As illustrated in FIG. 11, after the automobile wheel 84 passes the extension conduit 52, the flexible or resilient conduit wall 56 may return to the erect position due to the elastic recoil memory of the conduit wall 56. The extension conduit 52 may thus continue to minimize or limit entry of pooled precipitation 76 and/or falling precipitation 78 (FIG. 8) into the manhole opening 72 and sewer 74 and prevent storm water 80 from rising from the sewer 74 and overflowing the manhole opening 72, while facilitating discharge of sewer gas 60 from the sewer 74. As automobiles continue to traverse the roadway surface 86 and the manhole cover 2, the extension conduit 52 may continue to assume the compressed position illustrated in FIG. 10 as it is bended and substantially flattened between the automobile wheel 84 and the exterior manhole cover surface 5 of the manhole cover 2 each time an automobile wheel 84 rolls over the extension conduit 52, as illustrated in FIG. 10, and then return to the erect, functional position illustrated in FIG. 11.

It will be appreciated by those skilled in the art that the assembly 1 may prevent a substantial portion of falling precipitation 78 and/or pooled precipitation 76 from entering the sewer 74 through the manhole opening 72. The assembly 1 may facilitate escape of sewer gas 60 from the sewer 74 to the atmosphere 66 under normal weather conditions as well as during light rainfall or other falling precipitation 78, as well as prevent storm water 80 from rising from the sewer 74 and overflowing the manhole opening 72. The assembly 1 may additionally prevent application of a vacuum seal to the manhole cover 2, rendering ease in removal of the manhole cover 2 from the manhole opening 72. The assembly 1 may prevent rusting of the manhole cover 2 to the underlying manhole shoulder 71, also rendering ease in removal of the manhole cover 2 from the manhole opening 72. The assembly 1 may additionally prevent or reduce rattling of the manhole cover 2 as the automobile wheel 84 (FIG. 10) traverses the manhole cover 2 and the assembly 1.

Because of the elastic or resilient construction of the conduit wall 56, the extension conduit 52 may be capable of assuming the compressed position illustrated in FIG. 10 from the functional, erect position illustrated in FIGS. 9 and 11, responsive to application of generally downward pressure against the extension conduit 52. The extension conduit 52 may return or recoil to the functional, erect position responsive to removal of the generally downward pressure against the extension conduit 52. As used herein. "generally downward pressure" includes but is not limited to pressure which may be applied by an automobile wheel, a bicycle or other vehicle wheel or a shoe or foot of a pedestrian, for example and without limitation, in a vertically downward direction or at an obtuse angle or slope with respect to a horizontal axis or plane. The assembly 1 may prevent or at least minimize the perception of a bump to the operator of an automobile as the automobile wheel 84 rolls over the extension conduit 52 and traverses the roadway surface 86 and the manhole cover 2. It will be recognized and understood by those skilled in the art that the assembly 1 may be combined with various features including but not limited to a vent valve (not illustrated) and/or a gas deodorizing assembly (not illustrated) such as was heretofore described in U.S. Pat. No. 9,605,403, which is incorporated by reference herein in its entirety. The extension conduit 52 may be fabricated in various sizes to accommodate vent openings 20 and/or lift openings 26 of corresponding sizes.

While certain illustrative embodiments of the disclosure have been described above, it will be recognized and understood that various modifications can be made to the embodiments and the appended claims are intended to cover all such modifications which may fall within the spirit and scope of the disclosure.

What is claimed is:

1. A traffic-compatible vented precipitation guarding manhole cover assembly, comprising:

a manhole cover having an exterior manhole cover surface, an interior manhole cover surface and a manhole cover edge circumscribing the exterior manhole cover surface and the interior manhole cover surface;

at least one opening extending through the manhole cover from the interior manhole cover surface to the exterior manhole cover surface; and a flexible, resilient extension conduit extending from the exterior manhole cover surface at the at least one opening, the extension conduit including:

an elongated conduit wall having a conduit inlet end at the interior manhole cover surface and a conduit outlet end opposite the conduit inlet end and disposed beyond the exterior manhole cover surface, a conduit bore extending from the conduit inlet end to the conduit outlet end and a conduit flange carried by the extension conduit at the conduit inlet end, the conduit wall extending through the at least one opening; and the conduit wall insertable upwardly through the at least one opening from the interior manhole cover surface to the exterior manhole cover surface of the manhole cover until the conduit flange engages the interior manhole cover surface and the conduit outlet end of the conduit wall protrudes beyond the exterior manhole cover surface of the manhole cover; and the exterior manhole cover surface extending inwardly from the manhole cover edge and terminating at the manhole cover vent opening in the manhole cover, the exterior manhole cover surface being consistently flat or planar and entirely exposed from the manhole cover edge to the conduit wall of the extension conduit.

2. The traffic-compatible vented precipitation guarding manhole cover assembly of claim 1 wherein the at least one opening comprises at least one manhole cover vent opening.

3. The traffic-compatible vented precipitation guarding manhole cover assembly of claim 2 wherein the extension conduit is substantially centered on the exterior manhole cover surface.

4. The traffic-compatible vented precipitation guarding manhole cover assembly of claim 1 further comprising at least one manhole cover seal carried by the manhole cover.

5. The traffic-compatible vented precipitation guarding manhole cover assembly of claim 1 wherein the at least one opening comprises a plurality of lift openings, and the extension conduit extends from the exterior manhole cover surface at at least one of the plurality of lift openings.

6. The traffic-compatible vented precipitation guarding manhole cover assembly of claim 1 wherein the extension conduit comprises rubber.

7. The traffic-compatible vented precipitation guarding manhole cover assembly of claim 1 wherein the extension conduit is substantially perpendicular with respect to the exterior manhole cover surface of the manhole cover in an erect position of the extension conduit.

8. The traffic-compatible vented precipitation guarding manhole cover assembly of claim 1 further comprising a manhole structure having a manhole opening and a manhole shoulder circumscribing the manhole opening, and wherein the manhole cover is configured to be seated on the manhole shoulder.

9. A traffic-compatible vented precipitation guarding manhole cover assembly, comprising:

a manhole cover having an exterior manhole cover surface, an interior manhole cover surface and a manhole cover edge circumscribing the exterior manhole cover surface and the interior manhole cover surface;

at least one opening extending through the manhole cover from the interior manhole cover surface to the exterior manhole cover surface; and a flexible, resilient extension conduit extending from the exterior manhole cover surface at the at least one opening, the extension conduit being capable of assuming a compressed position against the exterior manhole cover surface of the manhole cover from an erect position responsive to application of generally downward pressure on the extension conduit, and the extension conduit recoils from the compressed position back to the erect position responsive to removal of the generally downward pressure from the extension conduit, the extension conduit including:

an elongated conduit wall having a conduit inlet end at the interior manhole cover surface and a conduit outlet end opposite the conduit inlet end and disposed beyond the exterior manhole cover surface, a conduit bore extending from the conduit inlet end to the conduit outlet end and a conduit flange carried by the extension conduit at the conduit inlet end, the conduit wall extending through the at least one opening;

the conduit wall insertable upwardly through the at least one opening from the interior manhole cover surface to the exterior manhole cover surface of the manhole cover until the conduit flange engages the interior manhole cover surface and the conduit outlet end of the conduit wall protrudes beyond the exterior manhole cover surface of the manhole cover; and the exterior manhole cover surface extending inwardly from the manhole cover edge and terminating at the manhole cover vent opening in the manhole cover, the exterior manhole cover surface being consistently flat or planar from the manhole cover edge to the conduit wall of the extension conduit.

10. The traffic-compatible vented precipitation guarding manhole cover assembly of claim 9 wherein the extension conduit comprises rubber.

11. The traffic-compatible vented precipitation guarding manhole cover assembly of claim 9 wherein the extension conduit is substantially perpendicular with respect to the exterior manhole cover surface of the manhole cover in the erect position of the extension conduit.

12. The traffic-compatible vented precipitation guarding manhole cover assembly of claim 9 further comprising a manhole structure having a manhole opening and a manhole shoulder circumscribing the manhole opening, and wherein the manhole cover is configured to be seated on the manhole shoulder.

13. A traffic-compatible vented precipitation guarding manhole cover assembly, comprising:

a manhole cover having a generally planar exterior manhole cover surface and an interior manhole cover surface and a manhole cover edge circumscribing the exterior manhole cover surface and the interior manhole cover surface;

a vent opening extending through the manhole cover from the interior manhole cover surface to the exterior manhole cover surface at substantially a geometric center of the manhole cover;

a plurality of lift openings extending through the manhole cover from the interior manhole cover surface to the exterior manhole cover surface at a plurality of substantially geometrically off-centered positions; and at least one flexible, resilient extension conduit extending from the exterior manhole cover surface through at least one of the vent opening and the plurality of lift openings, the extension conduit including:

an elongated conduit wall having a conduit inlet end at the at least one of the vent opening and the plurality of lit openings, a conduit outlet end opposite the conduit inlet end and disposed beyond the exterior manhole cover surface and a conduit bore extending from the conduit inlet end to the conduit outlet end, the conduit wall extending through the vent opening;

a conduit flange extending outwardly from the extension conduit at the conduit inlet end, the conduit flange engaging the interior manhole cover surface;

the extension conduit being capable of assuming a compressed position against the exterior manhole cover surface of the manhole cover from an erect position responsive to application of generally downward pressure on the extension conduit, and the extension conduit recoils from the compressed position back to the erect position responsive to removal of the generally downward pressure from the extension conduit;

the extension conduit is substantially perpendicular with respect to the exterior manhole cover surface of the manhole cover in the erect position of the extension conduit; and the conduit wall insertable upwardly through the vent opening from the interior manhole cover surface to the exterior manhole cover surface of the manhole cover until the conduit flange engages the interior manhole cover surface and the conduit outlet end of the conduit wall protrudes beyond the exterior manhole cover surface of the manhole cover; and the exterior manhole cover surface extending inwardly from the exterior manhole cover edge and terminating at the manhole cover vent opening in the manhole cover, the exterior manhole cover surface being consistently flat or planar and entirely exposed from the manhole cover edge to the conduit wall of the extension conduit.

14. The traffic-compatible vented precipitation guarding manhole cover assembly of claim 9 further comprising a manhole structure having a manhole opening and a manhole shoulder circumscribing the manhole opening, and wherein the manhole cover is configured to be seated on the manhole shoulder.

* * * * *